US007677752B2

(12) United States Patent
Tadokoro et al.

(10) Patent No.: US 7,677,752 B2
(45) Date of Patent: Mar. 16, 2010

(54) POWER TOOL EQUIPPED WITH LIGHT

(75) Inventors: Naoki Tadokoro, Hitachinaka (JP); Takuma Saito, Hitachinaka (JP); Takuya Teranishi, Hitachinaka (JP); Katsuhiro Oomori, Hitachinaka (JP); Kazuhiko Funabashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 236 days.

(21) Appl. No.: 11/782,691

(22) Filed: Jul. 25, 2007

(65) Prior Publication Data

US 2008/0025017 A1 Jan. 31, 2008

(30) Foreign Application Priority Data

Jul. 26, 2006 (JP) ..... P2006-202746
Sep. 7, 2006 (JP) ..... P2006-243170

(51) Int. Cl.
*B25B 23/18* (2006.01)

(52) U.S. Cl. ..... 362/119; 408/16

(58) Field of Classification Search ..... 362/119, 362/120, 800; 408/16, 241 R
See application file for complete search history.

(56) References Cited

U.S. PATENT DOCUMENTS 2,310,166 A * 2/1943 Way ..... 362/119
2,525,588 A * 10/1950 Cameron et al. ..... 362/119
5,158,354 A * 10/1992 Simonin ..... 362/119
5,797,670 A * 8/1998 Snoke et al. ..... 362/119
6,494,590 B1 12/2002 Paganini
7,185,998 B2 * 3/2007 Oomori et al. ..... 362/119
2003/0089510 A1 5/2003 Sugimoto et al.

FOREIGN PATENT DOCUMENTS

| | | |
|---|---|---|
| DE | 10 2004 051 913 | 2/2006 |
| EP | 1 445 073 | 8/2004 |
| EP | 1 477 282 | 11/2004 |
| JP | 2002-301669 | 10/2002 |
| JP | 2002 301669 A * | 10/2002 |
| JP | 2003-211374 | 7/2003 |
| JP | 2005-40934 | 2/2005 |

* cited by examiner

*Primary Examiner*—Bao Q Truong
(74) *Attorney, Agent, or Firm*—Antonelli, Terry, Stout & Kraus, LLP.

(57) ABSTRACT

A power tool includes a main housing, a motor, a hammer case, an end-tool holding part, a driving-force transmitting mechanism, a light-unit mounting part, a light unit, and a cover. The motor is accommodated in the main housing and is configured to generate a driving force. The hammer case has an outer peripheral surface. The end-tool holding part is configured to hold an end tool. The driving-force transmitting mechanism is accommodated in the hammer case. The driving-force transmitting mechanism is configured to transmit the driving force to the end-tool holding part. The light-unit mounting part is formed integrally with the hammer case. The light unit is mounted to the light-unit mounting part. The cover covers the outer peripheral surface of the hammer case and accommodates the light-unit mounting part and the light unit.

23 Claims, 10 Drawing Sheets

POWER TOOL EQUIPPED WITH LIGHT

BACKGROUND OF THE INVENTION

The present invention relates to a power tool, and particularly to a power tool having a light for irradiating an end tool and a workpiece.

Power tools, such as impact drivers, that come equipped with a light are well-known in the art. U.S. Pat. No. 7,185,998 (corresponding to Japanese Patent Application Publication No. 2003-211374) discloses a power tool including a housing accommodating a motor, a holding part for holding an end tool, and a hammer case for accommodating an impact mechanism that transmits driving force of the motor to the holding part. The power tool is also provided with a light-emitting diode (LED) or other light source that illuminates the front of the power tool so that work can be performed in dark locations safely and without difficulties.

SUMMARY OF THE INVENTION

The light source of the power tool including the LED or other light is mounted as a unit or assembly (hereinafter referred to as a "light unit") on the front of the housing or the front of the hammer case.

However, when using the power tool at a work site or when storing the power tool, it is conceivable that the light unit could receive an unanticipated impact due to the power tool colliding with a workpiece or being dropped.

Therefore, it is an object of the present invention to provide a power tool capable of preventing damage to a light unit caused by unanticipated impacts.

It is another object of the present invention to provide a power tool having construction for securely mounting a light unit in the body of the power tool.

This and other object of the present invention will be attained by a power tool including a main housing, a motor, a hammer case, an end-tool holding part, a driving-force transmitting mechanism, a light-unit mounting part, a light unit, and a cover. The motor is accommodated in the main housing and is configured to generate a driving force. The hammer case has an outer peripheral surface. The end-tool holding part is configured to hold an end tool. The driving-force transmitting mechanism is accommodated in the hammer case. The driving-force transmitting mechanism is configured to transmit the driving force to the end-tool holding part. The light-unit mounting part is formed integrally with the hammer case. The light unit is mounted to the light-unit mounting part. The cover covers the outer peripheral surface of the hammer case and accommodates the light-unit mounting part and the light unit.

According to another aspect, the present invention provides a power tool including a main housing, a motor, a hammer case, an end-tool holding part, a driving-force transmitting mechanism, a handle housing, a trigger switch, a light-unit mounting part, and a light unit. The main housing extends in a first direction. The motor is accommodated in the main housing and is configured to generate a driving force. The hammer case is provided adjacent to the main housing and has an outer peripheral surface. The end-tool holding part is configured to hold an end tool. The driving-force transmitting mechanism is accommodated in the hammer case. The driving-force transmitting mechanism is configured to transmit the driving force to the end-tool holding part. The handle housing is connected to the main housing. The handle housing extends in a second direction that intersects the first direction. The trigger switch is provided at the handle housing and adjacent to the hammer case. The trigger switch is configured to control power supply to the motor. The light-unit mounting part is provided at the outer peripheral surface of the hammer case and is formed integrally with the hammer case. The light-unit mounting part is formed with an insertion hole and with a slit. The light unit is accommodated in the insertion hole. The light unit has an engaging part that engages the slit.

According to still another aspect, the present invention provides a power tool including a main housing, a motor, a hammer case, an end-tool holding part, a driving-force transmitting mechanism, a handle housing, a trigger switch, a guide sleeve, a rib, and a light unit. The main housing extends in a first direction. The motor is accommodated in the main housing and is configured to generate a driving force. The hammer case is provided adjacent to the main housing and has an outer peripheral surface. The end-tool holding part is configured to hold an end tool, wherein the main housing, the hammer case, and the end-tool holding part are arranged in the first direction, such that the end-tool holding part is positioned at a front side and that the main housing is positioned at a rear side. The driving-force transmitting mechanism is accommodated in the hammer case. The driving-force transmitting mechanism is configured to transmit the driving force to the end-tool holding part. The handle housing is connected to the main housing. The handle housing extends in a second direction that intersects the first direction. The trigger switch is provided at the handle housing and adjacent to the hammer case. The trigger switch is configured to control power supply to the motor. The guide sleeve is provided at a front end of the hammer case. The rib protrudes from the outer peripheral surface of the hammer case and is provided between the trigger switch and the guide sleeve with respect to the first direction. The light unit includes a lighting element that irradiates light, and a holder member that holds the lighting element and that is mounted to the rib.

DETAILED DESCRIPTION OF THE PREFERRED EMBODIMENTS

First Embodiment

Figure 1:
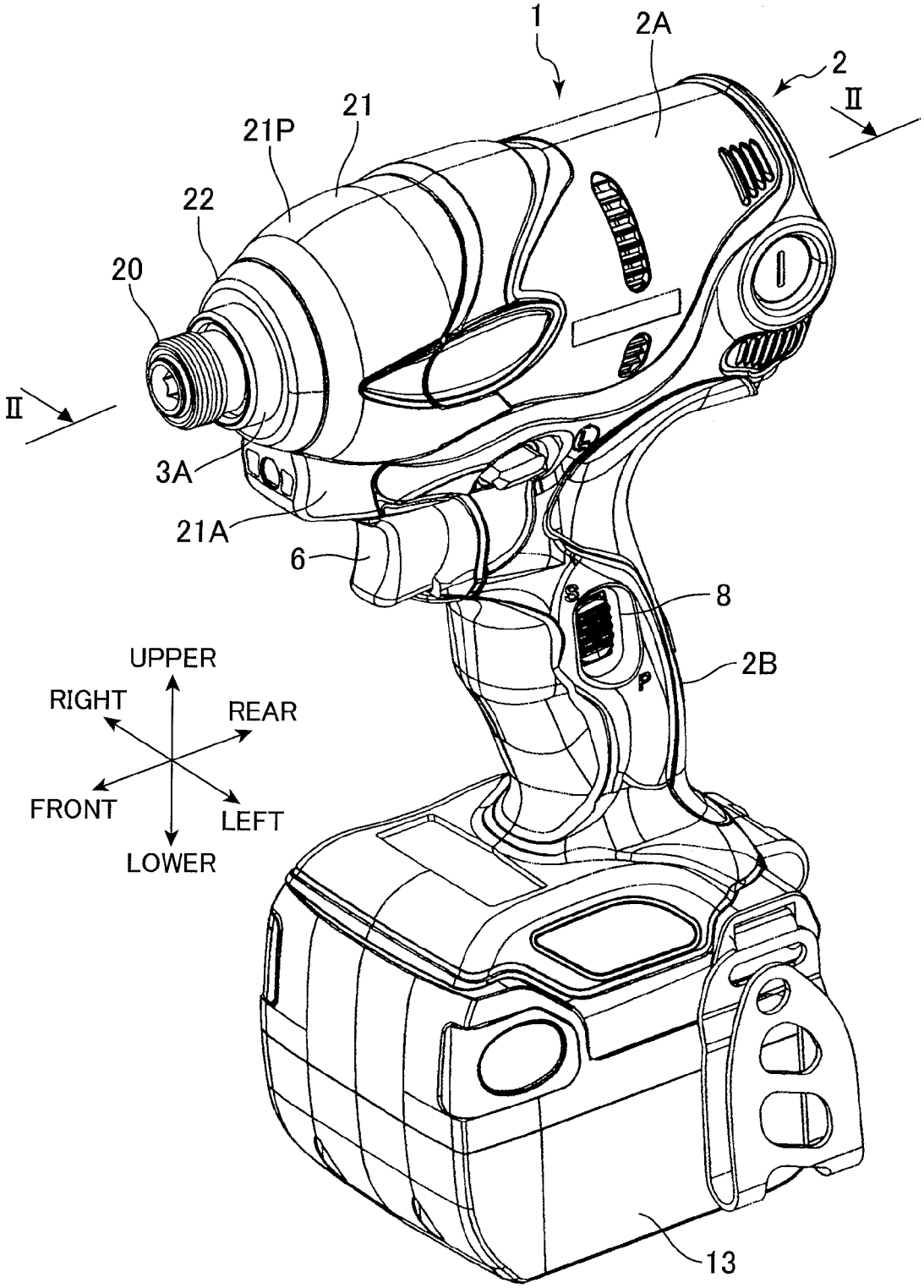
FIG. 1 is a perspective view of an impact driver according to a first embodiment of the present invention.

A power tool according to a first embodiment of the present invention will be described while referring FIGS. 1 through 9. In the following description and the drawings, the expressions "front", "rear", "upper", "lower", "right", and "left" are used only for description purposes.

First, the basic structure and operations of an impact driver 1 as an example of the power tool will be described with reference to FIGS. 1 through 3. As shown in the drawings, the impact driver 1 has a housing 2 and a hammer case 3 constituting an outer frame of the impact driver 1. The housing 2 includes a main body 2A substantially cylindrical in shape and extending in the front-to-rear direction, and a handle part 2B joined with the main body 2A to form a substantially T-shape in a side view. The hammer case 3 is substantially cylindrical in shape and formed of an aluminum alloy. The hammer case 3 is provided at the front end of the housing 2.

Figure 2:
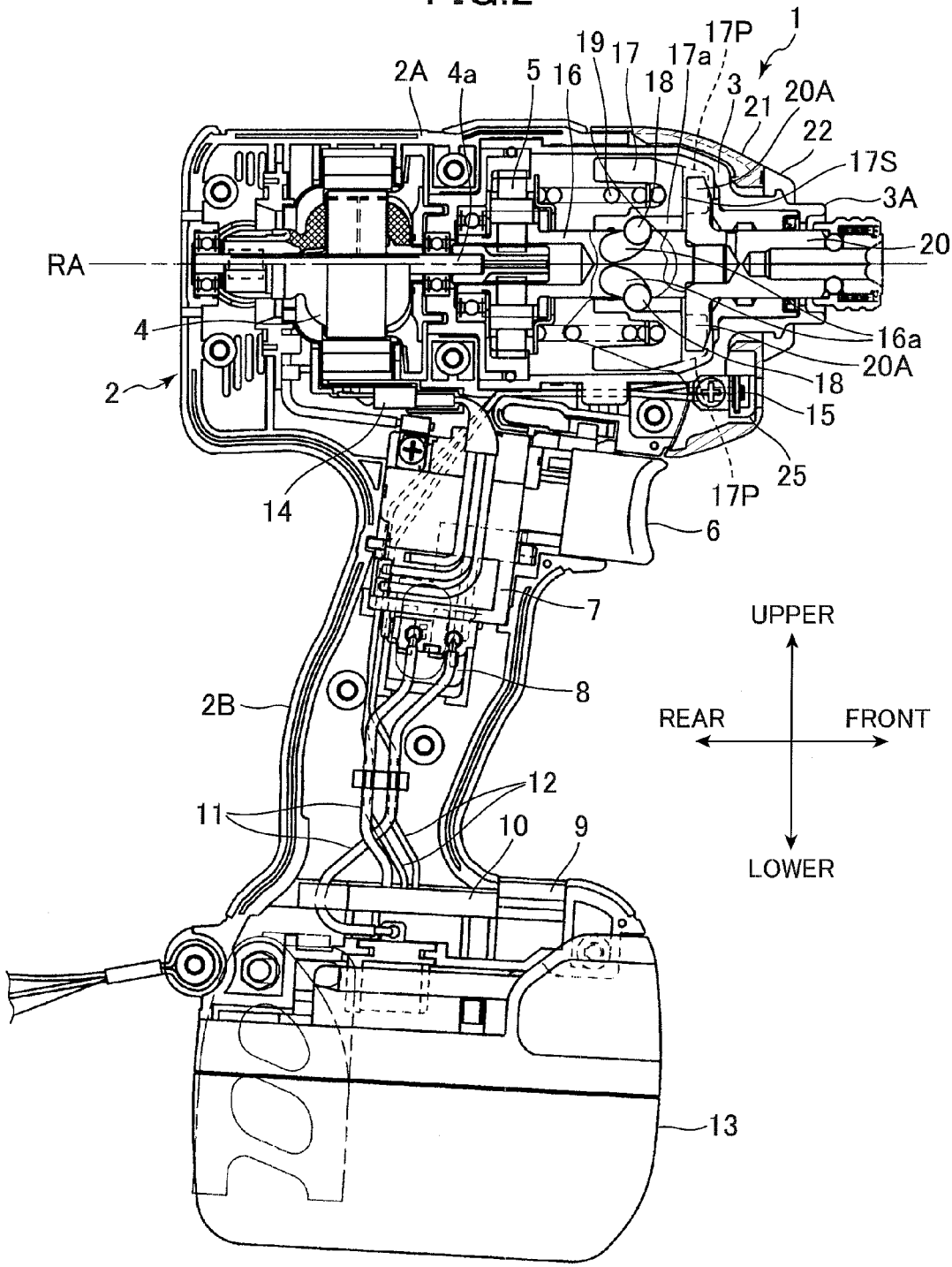
FIG. 2 is a cross-sectional view taken along a line II-II in FIG. 1, showing the internal structure of the impact driver.

As shown in FIGS. 1 and 2, a guide sleeve 3A is provided on the front end of the hammer case 3. A protector 21 is provided for covering the outer periphery of the hammer case 3 and a light unit 15 described later. The protector 21 is formed of a lightweight material such as an elastomer. The protector 21 includes a peripheral part 21P having a substantially cylindrical shape and a box-like pouch member 21A (light-unit accommodating part) that is integrally formed with the peripheral part 21P and that protrudes downward (radially outwardly) for accommodating the light unit 15. The protector 21 is fixed to the hammer case 3 by a stopper 22 formed of an elastic material such as rubber.

As shown in FIG. 2, a motor 4 serving as the drive source of the impact driver 1 is accommodated in the main body 2A of the housing 2. The motor 4 has an output shaft 4a for outputting a rotational force. The hammer case 3 accommodates a planetary gear mechanism 5 serving as a speed reduction mechanism for reducing the rotational speed of the motor 4, and an impact mechanism (not shown) for converting rotations of the motor 4 reduced by the planetary gear mechanism 5 to a rotational impact force and transmitting this force to an end tool (not shown). The impact mechanism includes a spindle 16, a hammer 17, balls 18, a spring 19, and an anvil 20 (end-tool holding part). The impact mechanism will be described in greater detail later.

A trigger 6 is provided at the upper section of the handle part 2B for switching power supply to the motor 4. A switch 7 connected to the trigger 6 is accommodated in the upper section of the handle part 2B. A switching lever 8, a battery receiving part 9, a circuit board 10, and lead wires 11 and 12 are accommodated in the lower section of the handle part 2B. A rechargeable battery 13 is detachably mounted on the bottom end of the handle part 2B. Power is supplied from the battery 13 to the motor 4 through the two lead wires 11, the switch 7, and a field-effect transistor (FET) 14. The light unit 15 is attached to the lower front end of the hammer case 3. Power is supplied from the battery 13 to the light unit 15 via the circuit board 10, and the two lead wires 12.

The motor 4 is activated when the user switches on the trigger 6. At this time, rotation of the output shaft 4*a* of the motor 4 is transmitted to the spindle 16 after being reduced by the planetary gear mechanism 5 and drives the spindle 16 to rotate at a prescribed speed. The spindle 16 is linked with the hammer 17 by a cam mechanism. The cam mechanism is configured of V-shaped spindle cam grooves 16*a* formed in the outer surfaces of the spindle 16, a V-shaped hammer cam groove 17*a* formed in the inner surface of the hammer 17, and the balls 18 engaged in the spindle cam grooves 16*a* and the hammer cam groove 17*a*.

The spring 19 constantly urges the hammer 17 in a frontward direction. During an idle state, a gap is formed between the hammer 17 and the anvil 20 by the engagement of the balls 18 and the spindle cam grooves 16*a* and the engagement of the balls 18 and the hammer cam grooves 17*a*. The hammer 17 has a pair of protrusions 17P which protrude from a surface 17S of the hammer 17 at symmetrical positions about a rotational axis RA. The anvil 20 has a pair of arms 20A which extend radially outwardly at symmetrical positions about the rotational axis RA. An end tool such as a bit (not shown) is detachably mounted to the anvil 20.

When the spindle 16 is driven to rotate at the prescribed speed described above, the cam mechanism transmits the rotation of the spindle 16 to the hammer 17. The protrusions 17P of the hammer 17 engage with the arms 20A of the anvil 20 before the hammer 17 completes a half rotation, thereby rotating the anvil 20. However, when the reaction force generated at the moment of this engagement produces relative rotation between the hammer 17 and the anvil 20, the hammer 17 begins to retract along the spindle cam grooves 16*a* toward the motor 4, while compressing the spring 19.

When the protrusions 17P of the hammer 17 slip over the arms 20A of the anvil 20, the protrusions 17P and the arms 20A disengage from each other due to the retraction of the hammer 17. Then, the elastic energy of the spring 19 and the operation of the cam mechanism are added to the rotational force of the spindle 16, accelerating the hammer 17 rapidly in the rotational direction and in the forward direction, while the urging force of the spring 19 moves the hammer 17 forward. The protrusions 17P of the hammer 17 once again engage with the arms 20A of the anvil 20, at which time the hammer 17 and anvil 20 begin rotating together. A strong rotational impact force is applied to the anvil 20 at this time and is transmitted to a screw (not shown) through the end tool mounted in the anvil 20.

As the above operation is repeated thereafter, the rotational impact force is intermittently and repeatedly transmitted from the end tool to the screw, driving the screw into the wood or other workpiece (not shown).

Figure 3:
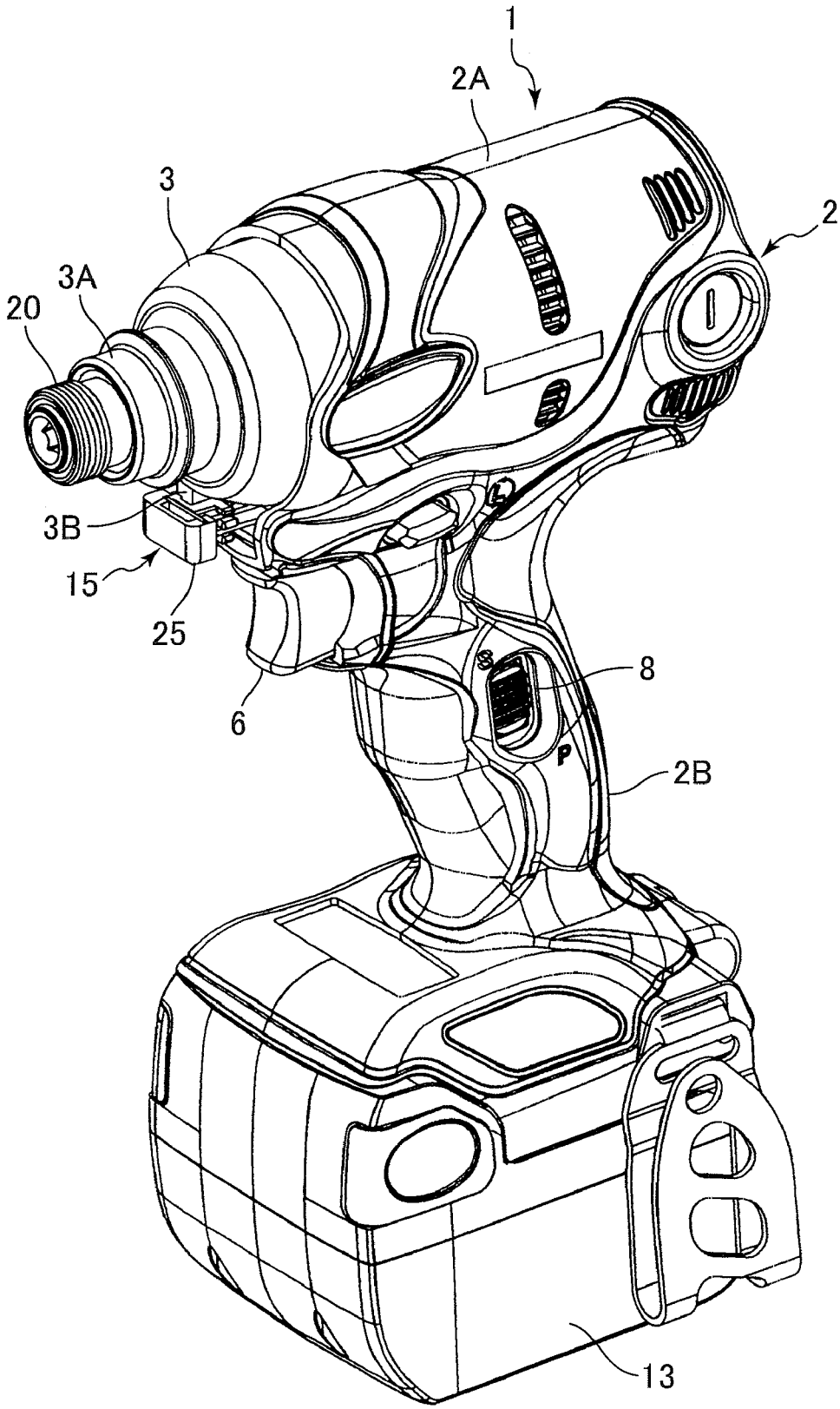
FIG. 3 is a perspective view showing the impact driver in FIG. 1 in a state where a protector has been removed.
Figure 4:
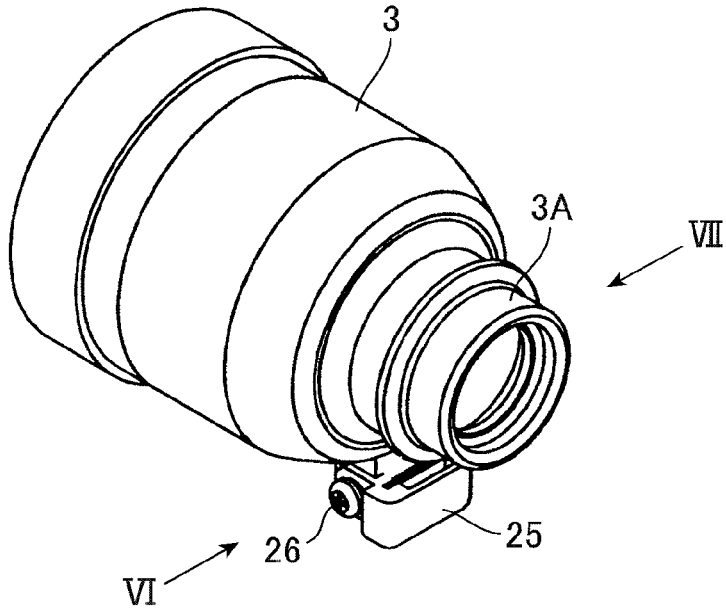
FIG. 4 is a perspective view of a hammer case having a mounted light unit for the impact driver in FIG. 1.

As shown in FIGS. 2 and 3, the light unit 15 is mounted at a position forward of the trigger 6 disposed below the hammer case 3 and rearward of the guide sleeve 3A provided on the front end of the hammer case 3.

The structure for mounting the light unit 15 will be described in detail with reference to FIGS. 4 through 9.

Figure 5:
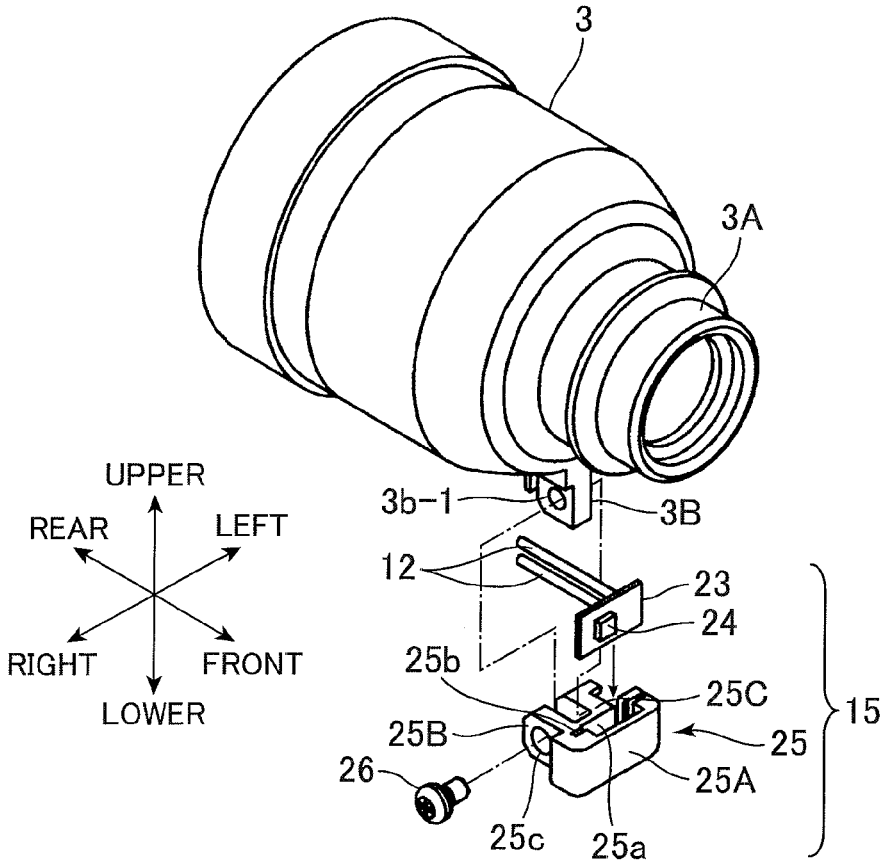
FIG. 5 is an exploded perspective view illustrating the structure for mounting the light unit on the hammer case for the impact driver in FIG. 1.
Figure 6:
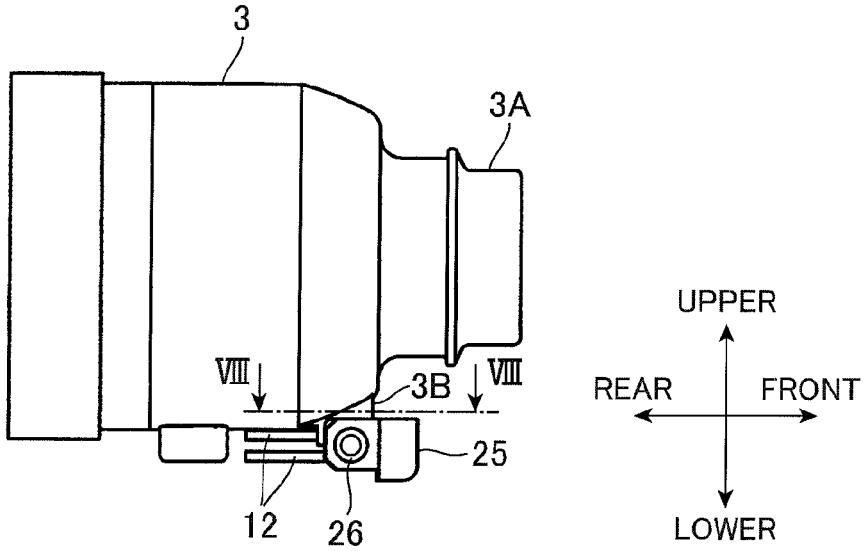
FIG. 6 is a side view of the hammer case as viewed from a direction VI shown in FIG. 4.

As shown in FIG. 5, a rib 3B (light-unit mounting part, protruding part) protrudes from the lower front end of the hammer case 3 at a position forward of the trigger 6 and rearward of the guide sleeve 3A. A screw hole 3*b*-1 is formed to penetrate the rib 3B in a left-right direction.

The light unit 15 shown in FIG. 5 includes a base plate 23, a chip LED 24 (lighting element), a holder member 25, and two lead wires 12. The base plate 23 has a thin rectangular plate shape. The LED 24 is attached to the base plate 23. The two lead wires 12 extend horizontally from upper and lower positions on a rear surface of the base plate 23. Note that the base plate 23, chip LED 24, and two lead wires 12 constitute a lighting-element unit.

The holder member 25 is integrally molded of a transparent resin, such as an acrylic. The holder member 25 has a block-shaped main body 25A in which are formed a rectangular accommodating space 25*a* open in the top of the main body 25A, and a slit-shaped fitting groove 25*b* elongated in the left-right direction and narrow in the front-rear direction. Two leg parts 25B and 25C protrude integrally from the surface of the main body 25A on right and left sides thereof. A circular hole 25*c* is formed to penetrate the leg part 25B in the left-right direction.

Figure 9:
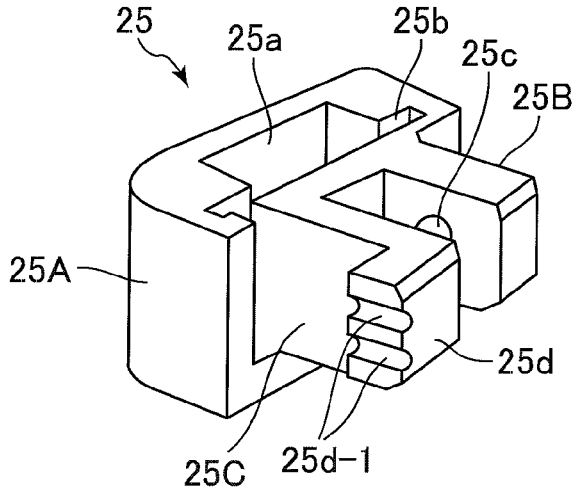
FIG. 9 is a perspective view of the holder member in FIG. 8.

As shown in FIG. 9, a holding part 25*d* is integrally provided on the end of the leg part 25C so that the leg part 25C and the holding part 25*d* form an L-shape in a plan view. Two fitting grooves 25*d*-1 extending horizontally in the front-rear direction are formed in a side endface of the holding part 25*d* at upper and lower positions thereof.

The light unit 15 is mounted on the lower front end of the hammer case 3 as described below. First, as shown in FIG. 5, the base plate 23 (attached with the chip LED 24 and the lead wires 12) is inserted from above into the slit-shaped fitting groove 25*b* of the holder member 25, such that the LED 24 is accommodated in the accommodating space 25*a* (see also FIG. 9), e.g. the holder member 25 forms a light cover which holds the lighting element 24.

Next, the holder member 25 holding the base plate 23 and the LED 24 is mounted on the rib 3B. More specifically, the rib 3B is fitted between the two leg parts 25B and 25C of the holder member 25, and a screw 26 is inserted through the hole 25*c* formed in the leg part 25B and screwed into the screw hole 3*b*-1 formed in the rib 3B.

Figure 7:
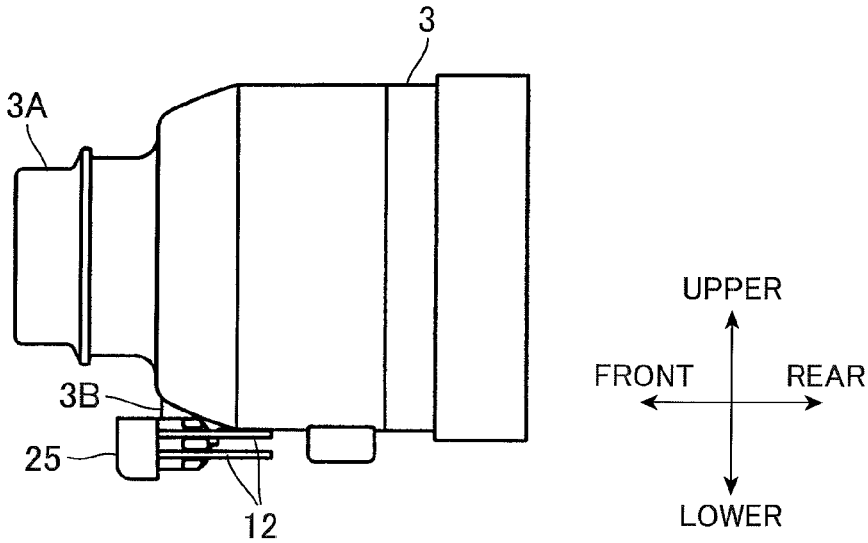
FIG. 7 is a side view of the hammer case as viewed from a direction VII shown in FIG. 4.
Figure 8:
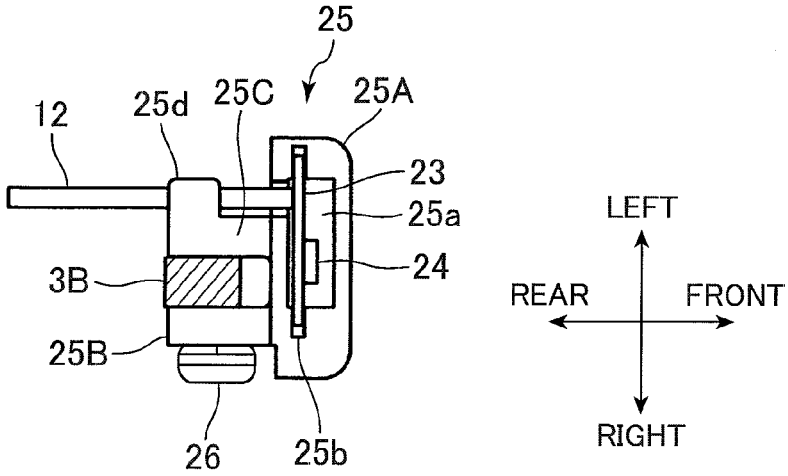
FIG. 8 is a cross-sectional view of a holder member along a line VIII-VIII shown in FIG. 6.

When the light unit 15 is mounted on the rib 3B (i.e., the lower front end of the hammer case 3) in this way, as shown in FIG. 7, the two lead wires 12 extending from the base plate 23 are fitted into and fixed in the two fitting grooves 25*d*-1 (see also FIG. 9).

With this construction, the impact driver 1 can be used to perform operations in dark areas, such as under flooring or in an attic. By turning on a switch (not shown) to supply power from the battery 13 to the light unit 15 via the circuit board 10 and lead wires 12, light irradiated from the LED 24 illuminates the end tool and workpiece (not shown), thereby enabling the user to work efficiently and without difficulty.

In the impact driver 1 according to the present embodiment, the holder member 25 is used to mount the light unit 15 on the rib 3B. As described above, the rib 3B protrudes from the lower front end of the hammer case 3 at a position forward of the trigger 6 and rearward of the guide sleeve 3A disposed on the front end of the hammer case 3. Accordingly, the light unit 15 is positioned closer to the end tool and workpiece, which are the illumination targets, enabling a small LED 24 with a low capacity to illuminate the target with sufficient brightness. Hence, the light unit 15 can be made smaller and more compact.

With the impact driver 1 according to the present embodiment, the small LED 24 is easy to mount in the holder member 25 by simply inserting the base plate 23 into the slit-shaped fitting groove 25*b* from the top of the holder member 25. Next, the holder member 25 can be easily and reliably mounted on the rib 3B of the hammer case 3 using the screw 26.

Further, the base plate 23 is prevented from floating up from the holder member 25 by fitting the lead wires 12 into the two upper and lower fitting grooves 25*d*-1. Hence, a screw or other fastener is not needed to fix the base plate 23 to the holder member 25, thereby reducing the number of required parts and reducing the manufacturing cost.

Second Embodiment

Figure 10:
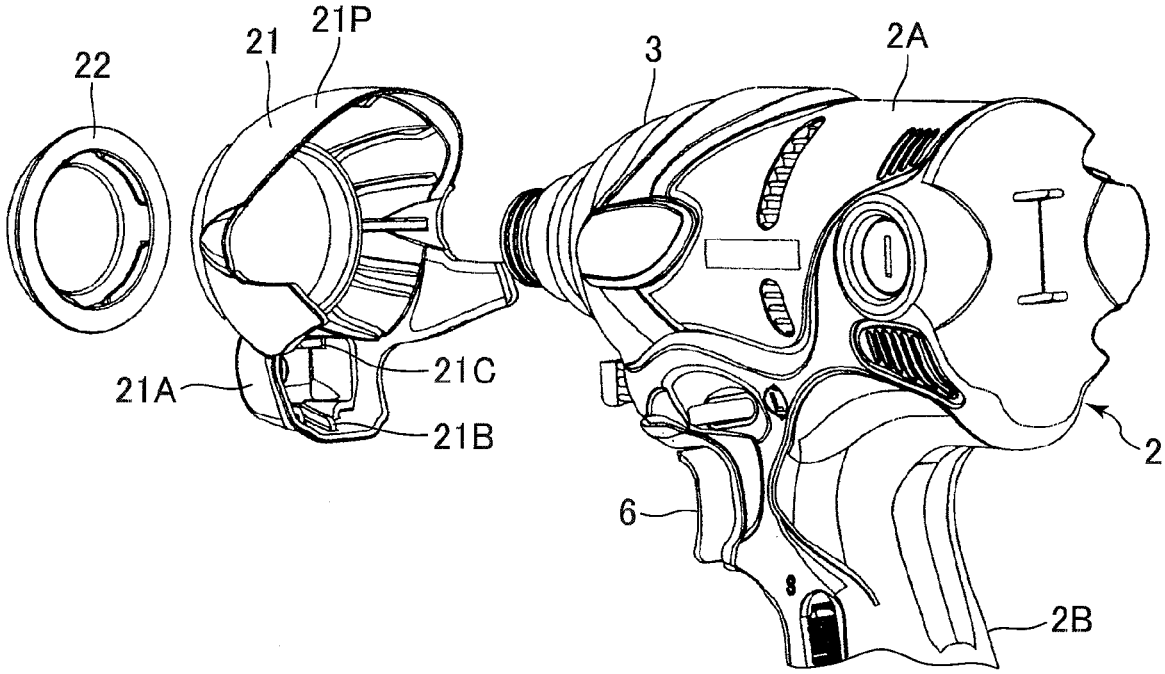
FIG. 10 is an exploded perspective view showing an impact driver according to a second embodiment of the present invention.
Figure 11:
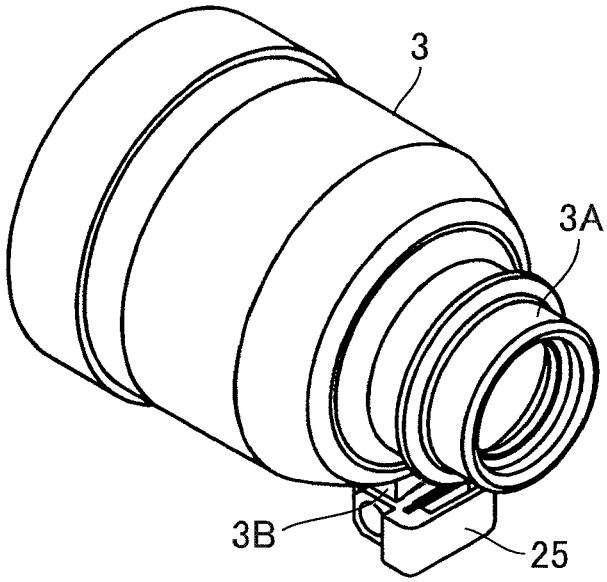
FIG. 11 is a perspective view of a hammer case of the impact driver in FIG. 10, in which a light unit is mounted to the hammer case.
Figure 12:
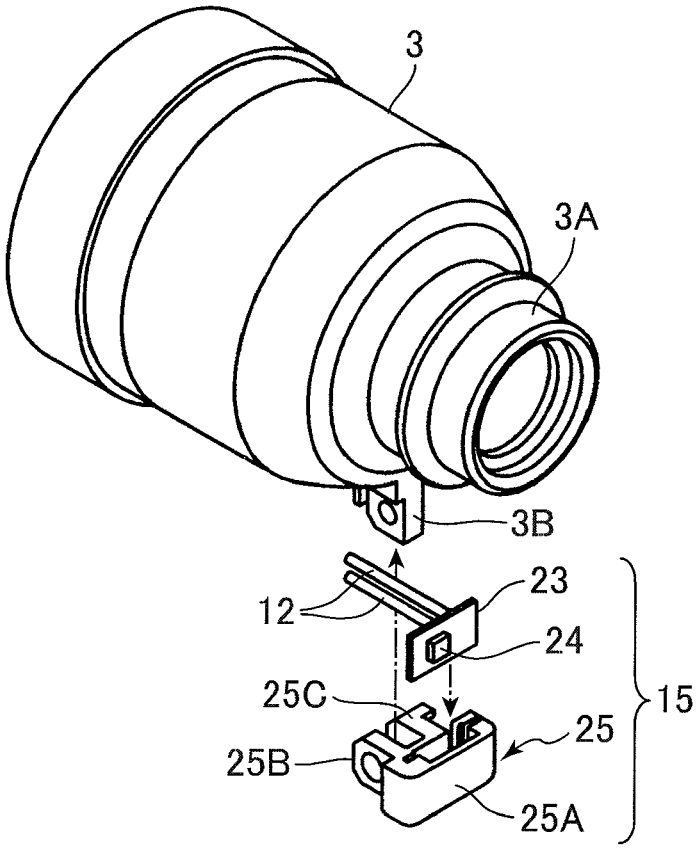
FIG. 12 is an exploded perspective view illustrating the structure for mounting the light unit on the hammer case for the impact driver in FIG. 10.

A power tool according to a second embodiment of the invention will be described while referring to FIGS. 10 through 12, wherein like parts and components are designated by the same reference numerals to avoid duplicating description.

In the second embodiment, the holder member 25 retaining the base plate 23 and LED 24 is attached to the hammer case 3 by fitting the holder member 25 onto the rib 3B of the hammer case 3. First, by simply fitting the rib 3B between the leg parts 25B and 25C of the holder member 25 shown in FIG. 12, the holder member 25 can be easily mounted on the rib 3B in one step, as shown in FIG. 11. In other words, a faster such as screw is not used in the present embodiment.

After the holder member 25 is mounted on the rib 3B as described above, the protector 21 shown in FIG. 10 covers and retains the holder member 25. Specifically, a lower rib-shaped guide 21B is integrally formed in the pouch member 21A, protruding upward from the inside lower surface of the pouch member 21A. Similarly, an upper rib-shaped guide 21C is integrally formed in the pouch member 21A, protruding downward from the inside upper surface of the pouch member 21A.

The holder member 25 mounted on the rib 3B of the hammer case 3 is fitted into the pouch member 21A of the protector 21 along the guides 21B and 21C. Accordingly, the pouch member 21A covers and holds the holder member 25, with the lower surface of the holder member 25 received by and supported on the lower guide 21B and with the upper surface of the holder member 25 received by and supported on the upper guide 21C.

According to the second embodiment, in addition to the effects of the first embodiment described above, the holder member 25 can be easily fitted over and mounted on the rib 3B of the hammer case 3 in one step and can be reliably retained by the protector 21. Hence, the holder member 25 is reliably prevented from falling off the rib 3B.

Third Embodiment

A power tool according to a third embodiment of the invention will be described while referring to FIGS. 13 through 19, wherein like parts and components are designated by the same reference numerals to avoid duplicating description.

Figure 13:
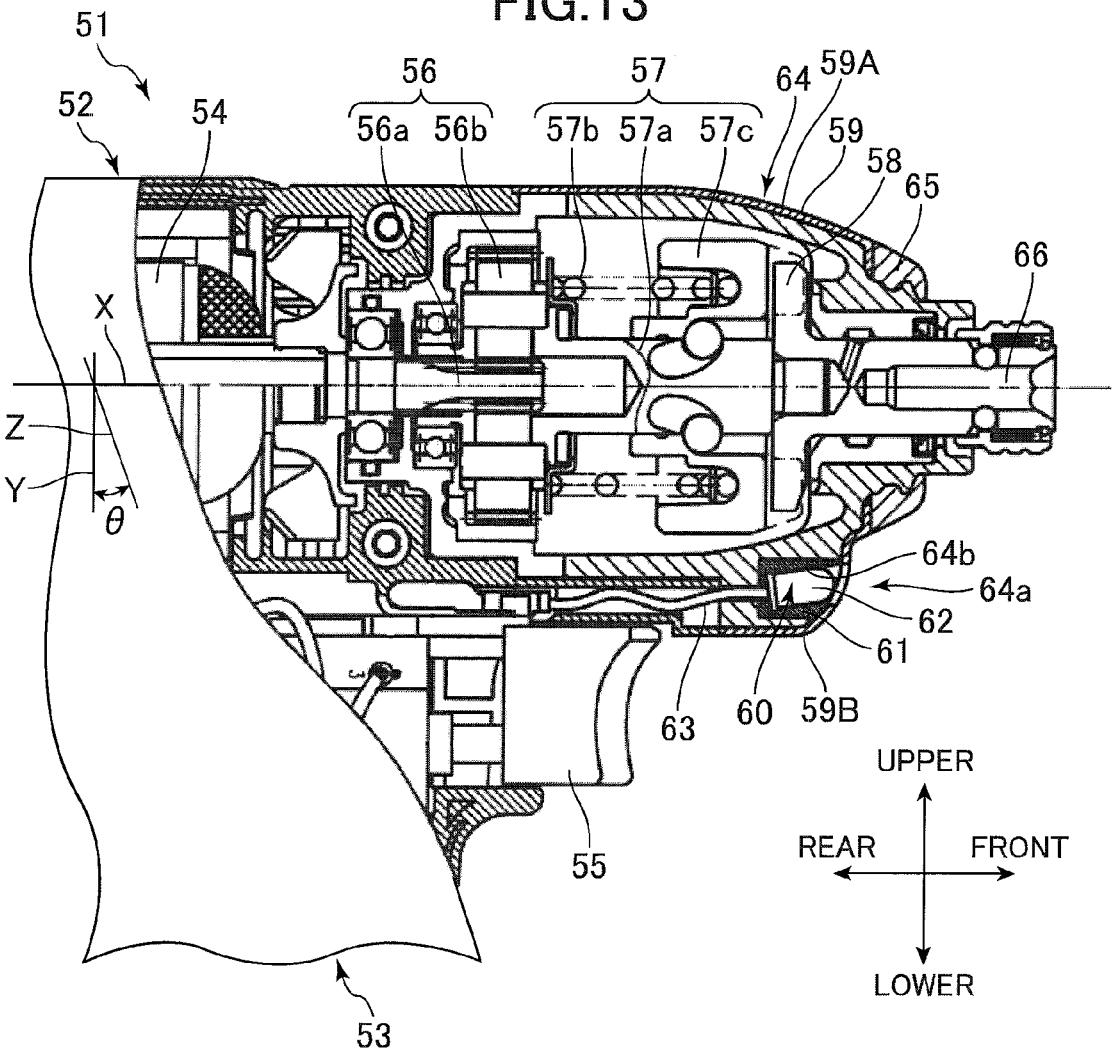
FIG. 13 is a partial side cross-sectional view of an impact driver according to a third embodiment of the present invention.

FIG. 13 shows an impact driver 51 according to the third embodiment. As shown in FIG. 13, the impact driver 51 includes a main housing 52 substantially cylindrical in shape and extending in a front-rear direction along a rotational axis X of a DC motor 54; a handle housing 53 joined with the main housing 52 and extending in a vertical Y-direction orthogonal to the extending direction of the main housing 52 (X-direction) or a Z-direction at a certain angle θ from the Y-direction; and a hammer case 64 that is bell-shaped and accommodates an impact mechanism. The main housing 52 is coupled to the hammer case 64 by screws (not shown). A battery pack housing section (not shown) is provided in a lower end portion of the handle housing 53, and a battery pack (not shown) is mounted in the battery pack housing section.

From the rear end to the front end of the main housing 52 in the X-direction, the main housing 52 accommodates the motor 54, and a speed reduction mechanism 56. The speed reduction mechanism 56 includes a pinion 56*a* which serves as an output shaft of the motor 54, and a planetary gear 56*b* engaged with the pinion 56*a*.

The hammer case 64 accommodates an impact mechanism 57, and an anvil 58 that receives an impact force from the impact mechanism 57 and rotates. The impact mechanism 57 includes a spindle 57*a* for transmitting the rotational force from the speed reduction mechanism 56, a coil spring 57*b* provided around an outer surface of the spindle 57*a*, and a hammer 57*c* that generates an impact force by the action of the coil spring 57*b*. An end-tool holding part 66 is provided on a front end of the anvil 58 for detachably mounting a drill bit (not shown) or other end tool. The drill bit or desired end tool can be inserted into the end-tool holding part 66 and clamped therein. A protective cover 59 includes a peripheral part 59A covering an outer peripheral surface of the hammer case 64, and a protruding part 59B protruding downward (radially outwardly) from the peripheral part 59A for accommodating the light-unit accommodating part 64*a* and the light unit 60. The protective cover 59 is formed of an elastic material such as rubber. A front cap 65 fits onto a front end of the hammer case 64 for preventing the protective cover 59 from coming unseated.

A trigger switch 55 is provided on the handle housing 53 positioned below the hammer case 64 for controlling the supply of power from the battery pack (not shown) to the motor 54. When the trigger switch 55 is switched on, the motor 54 is driven to rotate. The rotational force of the motor 54 is transmitted via the speed reduction mechanism 56 and impact mechanism 57 provided in the main housing 52 and the anvil 58 provided in the hammer case 64. Since the end tool is mounted in the end-tool holding part 66, the force is transmitted to the end tool as a rotational impact force for driving a screw or other fastener into a workpiece (not shown).

In this construction, the light-unit accommodating part 64*a* (light-unit mounting part) is integrally provided as a member of the hammer case 64 at a position on a lower peripheral surface of the hammer case 64. A light unit (light assembly) 60 is mounted in the light-unit accommodating part 64*a*. The light unit 60 includes a lighting element 62 configured of an LED, for example. As will be described later, the optical axis of the lighting element 62 is adjusted so that the lighting element 62 can irradiate light in front of and to left and right sides of the end-tool holding part 66. Further, the lighting element 62 is accommodated at a position as near as possible to the rotational axis X. The lighting element 62 irradiates light in front of and to the left and right sides of the end-tool holding part 66 in synchronization with an ON operation of the trigger switch 55, enabling the impact driver 51 to be used in a dark work area.

Figure 14:
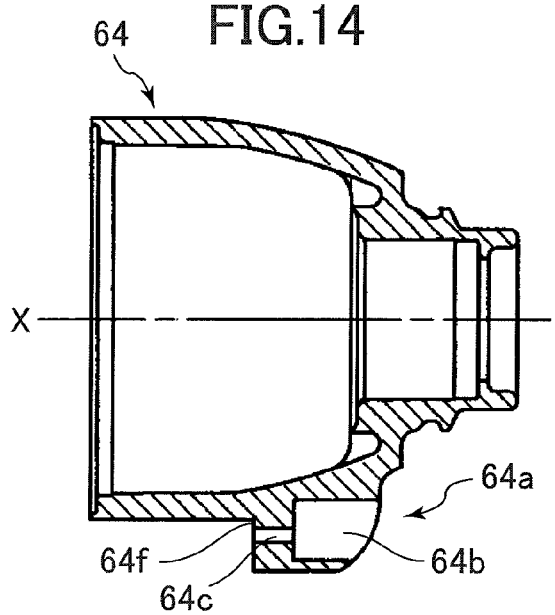
FIG. 14 is a cross-sectional view along an X-Y plane of a hammer case provided on the impact driver in FIG. 13.

As shown in FIG. 13, the light unit 60 includes a light cover 61 described later (see FIGS. 16A through 16C), the lighting element 62 configured of an LED or the like, and a lead wire 63 electrically connecting the lighting element 62 to a power supply circuit provided in the handle housing 53. As shown in FIG. 14, the light-unit accommodating part 64a accommodating the light unit 60 is integrally formed with the hammer case 64 at a position on a lower peripheral surface of the hammer case 64.

Figure 15:
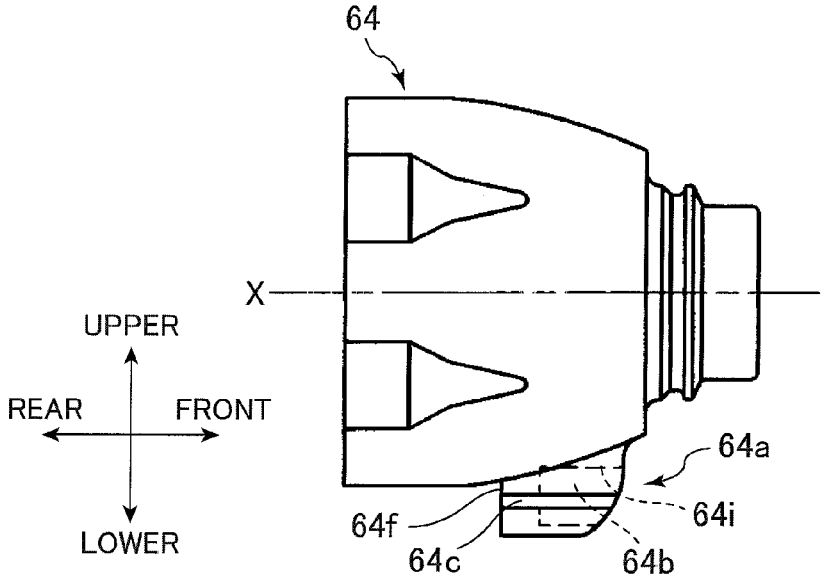
FIG. 15 is a side view of the hammer case.
Figure 16A:
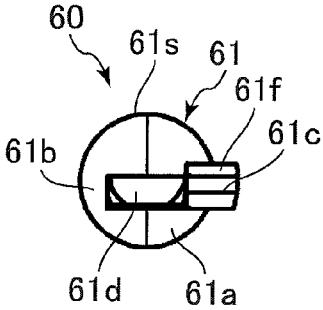
FIG. 16A is a rear view of a light cover for the impact driver in FIG. 13.
Figure 16B:
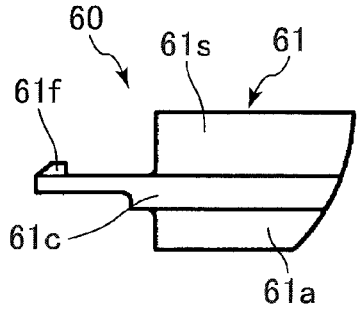
FIG. 16B is a side view of the light cover for the impact driver in FIG. 13.
Figure 16C:
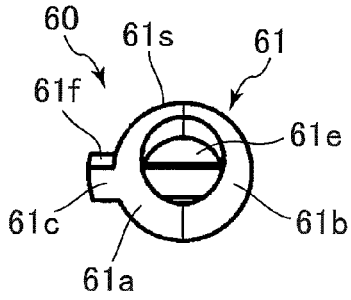
FIG. 16C is a front view of the light cover for the impact driver in FIG. 13.

As shown in FIG. 14, an insertion hole (nest) 64*b*(concave part) for accommodating the light unit 60 is formed in the light-unit accommodating part 64*a*. The insertion hole 64*b* has an inner peripheral surface 64*i*. As shown in FIG. 15, a slit 64*c* is formed in the light-unit accommodating part 64*a* in the front-rear direction. The slit 64*c* extends over the entire protruding part of the light-unit accommodating part 64*a* along an insertion direction in which the light unit 60 is inserted in the insertion hole 64*b*.

As shown in FIGS. 16A through 17A, the light cover 61 constituting part of the light unit 60 has an engaging part (protruding part) 61*c*. The light cover 61 also has an outer peripheral surface 61*s*. When a main body of the light unit 60 is inserted into the insertion hole 64*b* formed in the light-unit accommodating part 64*a*, the engaging part 61*c* slidingly engaged with the slit 64*c* simultaneously. At this time, the outer peripheral surface 61*s* of the light cover 61 slides on the inner peripheral surface 64*i* of the insertion hole 64*b*. An engaging part (hook part) 61*f* is provided on a rear end of the engaging part 61*c*. When the light cover 61 is completely inserted into the insertion hole 64*b*, the engaging part 61*f* engages with a rear wall portion 64*f* of the light-unit accommodating part 64*a*, as illustrated in FIG. 19, thus fixing the light cover 61 in the light-unit accommodating part 64*a*.

Figure 17A:
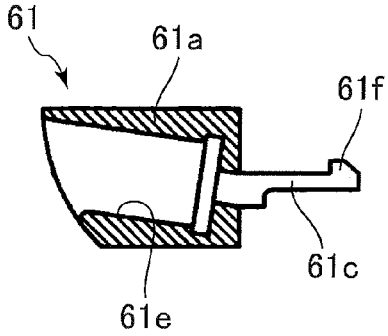
FIG. 17A is a side view of a first half-split cover of the light cover, wherein the hatched region shows a surface joined with a second half-split cover shown in FIG. 17B.
Figure 17B:
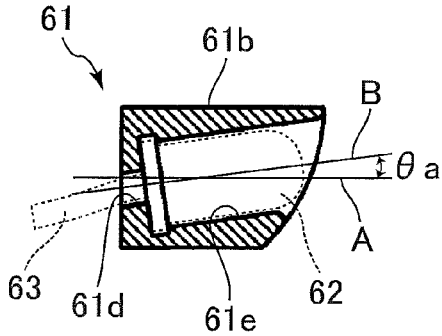
FIG. 17B is a side view of the second half-split cover of the light cover, wherein the hatched region shows the surface joined with the first half-split cover shown in FIG. 17A, and the dotted lines show a light and a lead wire mounted in the second half-split cover.

As shown in FIGS. 17A and 17B, the light cover 61 is formed by joining a first half-split cover 61*a* (shown in FIG. 17A) and a second half-split cover 61*b* (shown in FIG. 17B). Note that the hatched regions in FIGS. 17A and 17B show joining surfaces between the half-split covers 61*a* and 61*b*. As shown in FIG. 17B, the lighting element 62 is first arranged in a light insertion hole (recessed part) 61*e* formed in the second half-split cover 61*b*, with the lead wire 63 drawn out through a lead wire hole 61*d*. Next, the first half-split cover 61*a* is placed over the second half-split cover 61*b*, forming the light cover 61 that can be inserted into the insertion hole 64*b* of the light-unit accommodating part 64*a*. At this time, the optical axis of the lighting element 62, i.e. a center axis B of the light insertion hole 61*e*, is adjusted to a prescribed angle θa relative to a center axis A of the light cover 61.

Figure 18:
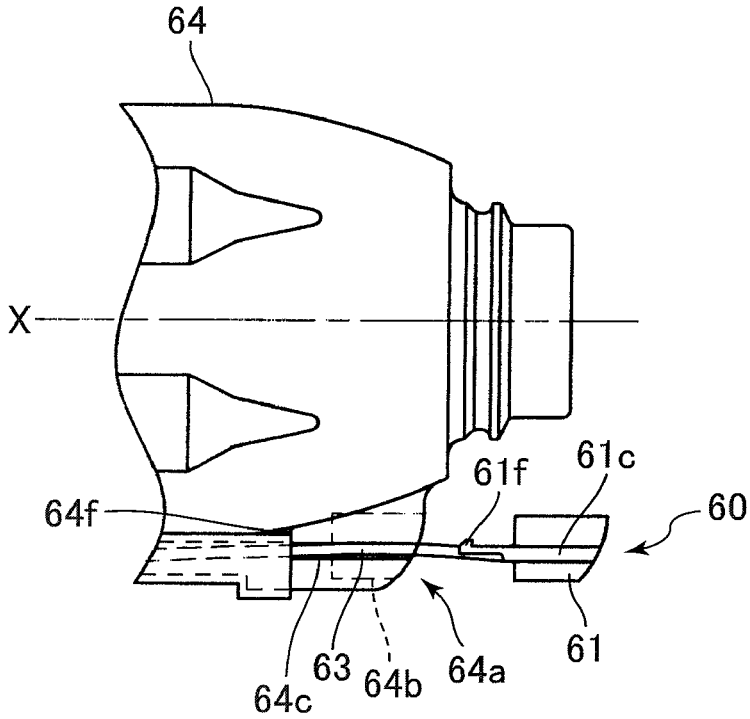
FIG. 18 is a side view of the impact driver in FIG. 1, particularly showing a region around the hammer case and illustrating a state before a light unit is mounted to the hammer case.
Figure 19:
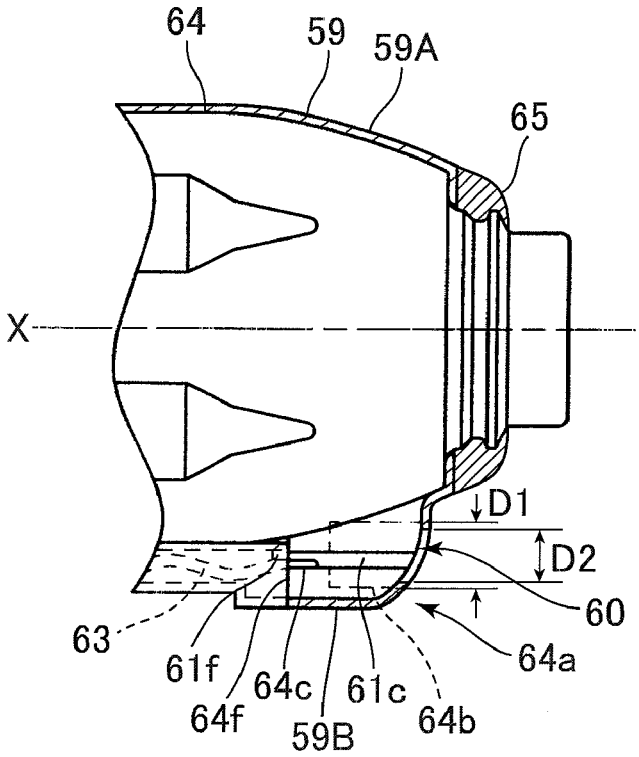
FIG. 19 is a side view with a partial cross section for showing the region shown in FIG. 18, illustrating a state where the light unit has been mounted to the hammer case and where a protective cover and a front cap have been put on the hammer case.

As illustrated in FIGS. 18 and 19, the light unit 60 configured of the lighting element 62, the lead wire 63, and the light cover 61 is inserted into the insertion hole 64*b* formed in the light-unit accommodating part 64*a* according to the following procedure.

First, as shown in FIG. 18, the lead wire 63 of the light unit 60 is inserted through the slit 64*c* in the light-unit accommodating part 64*a*, and pulled out from the rear of the light-unit accommodating part 64*a*.

Next, as shown in FIG. 19, the main body of the light unit 60 is inserted into the insertion hole 64*b*. At this time, the engaging part 61*c* of the light unit 60 slides in the slit 64*c*. When the light cover 61 is inserted all the way into the insertion hole 64*b*, the engaging part 61*f* engages with the rear wall portion 64*f* of the light-unit accommodating part 64*a*, thereby serving as a first retaining member. Further, since the slit 64*c* and the rear wall portion 64*f* fix the position of the engaging part 61*c*, the light unit 60 can be accommodated at a prescribed positional relationship with the light-unit accommodating part 64*a*.

After the main body of the light unit 60 has been inserted into the insertion hole 64*b*, the protective cover 59 formed of rubber or another elastic material is fitted over the hammer case 64. The protruding part 59B of the protective cover 59 is formed with a window (hole) at a diameter D2 which is smaller than a diameter D1 of the insertion hole 64*b*. Hence, the protective cover 59 can enhance the reliability of holding the lighting element 62 in the insertion hole 64*b* when fitted over the light-unit accommodating part 64*a* of the hammer case 64. After mounting the protective cover 59, the front cap 65 is attached to the front end part of the hammer case 64, thereby preventing the protective cover 59 from coming unseated. Accordingly, the protective cover 59 and the front cap 65 serve as a second retaining member for the light unit 60.

With the above-described construction, the light unit 60 can be accurately positioned when inserted into the insertion hole 64*b*, thereby obtaining a predetermined light-irradiating angle. Further, the engaging part 61*f* of the light cover 61 engages with the light-unit accommodating part 64*a* of the hammer case 64, as shown in FIG. 19, preventing the light unit 60 from coming out, to the front, from the insertion hole 64*b*.

Further, since the lighting element 62 can be disposed in the light-unit accommodating part 64*a* of the hammer case 64 and the light unit 60 can be positioned near the rotational axis X and the front end of the impact driver 51, the illuminating range of the lighting element 62 can be increased. That is, the lighting element 62 can illuminate a broad region in order to support different lengths of screws driven by the end tool and different lengths of the end tool, while eliminating shadows formed by the body of the impact driver 51.

Further, forming the light cover 61 of an elastic material can reduce the effects of vibrations generated in the body of the impact driver 51 and heat generated in the hammer case 64. Further, the protective cover 59 is configured of an elastic material that can absorb unanticipated impacts, such as when the impact driver 51 collides with a workpiece, thereby preventing damage to the light-unit accommodating part 64*a* or the light unit 60.

Further, since the light unit 60 according to the present embodiment is fixed by the light-unit accommodating part 64*a* and the engaging part 61*c* and, hence, requires no screws, the light unit 60 can easily be removed from the hammer case 64 by disengaging the engaging part 61*f* from the light-unit accommodating part 64*a*, thereby facilitating replacement of the lighting element 62. By using plugs and sockets as the method of connecting wiring for the lighting element 62, connection and mounting of the electric parts can also be simplified.

While the invention has been described in detail and with reference to specific embodiment thereof, it would be apparent to those skilled in the art that various changes and modifications may be made therein without departing from the spirit and scope of the invention.

In the above-described embodiments, the present invention is applied to a cordless impact driver equipped with a rechargeable battery, but the present invention may also be applied to an impact driver having an electric cord. Further, it should be apparent that the present invention is not limited to impact drivers, but may be applied to a wide range of power tools, such as a nail gun.

What is claimed is:

1. A power tool comprising:

a main housing;

a motor accommodated in the main housing and configured to generate a driving force;

a hammer case having an outer peripheral surface;

an end-tool holding part that is configured to hold an end tool;

a driving-force transmitting mechanism accommodated in the hammer case, the driving-force transmitting mechanism being configured to transmit the driving force to the end-tool holding part;

a light-unit mounting part that is formed integrally with the hammer case as an outwardly protruding part of said outer peripheral surface;

a light unit mounted to the light-unit mounting part and positioned below the hammer case, the light unit including a lighting element and a light cover which holds the lighting element; and a protector cover that covers the outer peripheral surface of the hammer case and the light unit with a covering range ranging from a position above the hammer case to a position below the light unit and that accommodates the light-unit mounting part and the light unit to protect against impact of the power tool with a workpiece.

2. The power tool as claimed in claim 1, wherein the protector cover includes:

a peripheral part that covers the outer peripheral surface of the hammer case; and a light-unit accommodating part that protrudes radially outwardly from the peripheral part, thereby accommodating the light-unit mounting part and the light unit.

3. The power tool as claimed in claim 1, wherein the light-unit mounting part has a concave part that accommodates the light unit.

4. The power tool as claimed in claim 3, wherein the concave part includes an insertion hole in which the light unit is inserted.

5. The power tool as claimed in claim 4, wherein the insertion hole having a first diameter; and wherein the protector cover has an opening with a second diameter smaller than the first diameter.

6. A power tool comprising:

a main housing;

a motor accommodated in the main housing and configured to generate a driving force;

a hammer case having an outer peripheral surface;

an end-tool holding part that is configured to hold an end tool;

a driving-force transmitting mechanism accommodated in the hammer case, the driving-force transmitting mechanism being configured to transmit the driving force to the end-tool holding part;

a light-unit mounting part that is formed integrally with the hammer case;

a light unit mounted to the light-unit mounting part;

a cover that covers the outer peripheral surface of the hammer case and that accommodates the light-unit mounting part and the light unit;

wherein the light-unit mounting part has a concave part that accommodates the light unit;

wherein the concave part includes an insertion hole in which the light unit is inserted;

wherein the light unit includes a lighting element and a light cover having an outer peripheral surface;

wherein the insertion hole has an inner peripheral surface; and wherein the light unit is inserted in the insertion hole such that the outer peripheral surface of the light cover slides on the inner peripheral surface of the insertion hole.

7. The power tool as claimed in claim 4, wherein the light-unit mounting part is further formed with a slit; and wherein the light unit has an engaging part that engages the slit.

8. The power tool as claimed in claim 1, wherein the light-unit mounting part has a protruding part to which the light unit is mounted.

9. A power tool comprising:

a main housing;

a motor accommodated in the main housing and configured to generate a driving force;

a hammer case having an outer peripheral surface;

an end-tool holding part that is configured to hold an end tool;

a driving-force transmitting mechanism accommodated in the hammer case, the driving-force transmitting mechanism being configured to transmit the driving force to the end-tool holding part;

a light-unit mounting part that is formed integrally with the hammer case;

a light unit mounted to the light-unit mounting part;

a cover that covers the outer peripheral surface of the hammer case and that accommodates the light-unit mounting part and the light unit;

wherein the light-unit mounting part has a protruding part to which the light unit is mounted; and wherein the protruding part includes a rib that protrudes from the outer surface of the hammer case.

10. The power tool as claimed in claim 9, wherein the light unit comprises:

a lighting-element unit; and a holder member that holds the lighting-element unit and that is mounted to the rib.

11. The power tool as claimed in claim 10, wherein the lighting-element unit includes a base member that is inserted into the holder member, and a chip LED that is attached to the base member.

12. The power tool as claimed in claim 11, wherein the holder member is formed with two grooves;

wherein the lighting-element unit further includes two lead wires that extend from the base member; and wherein the two lead wires are fitted in respective ones of the two grooves.

13. The power tool as claimed in claim 10, wherein the holder member is mounted to the rib by a screw.

14. The power tool as claimed in claim 1, wherein the hammer case is made of metal.

15. The power tool as claimed in claim 1, wherein the protector cover is made of an elastic material.

16. The power tool as claimed in claim 1, wherein the motor has an output shaft extending in an axial direction;

wherein the main housing, the hammer case, and the end-tool holding part are arranged in the axial direction, such that the end-tool holding part is positioned at a front side and that the main housing is positioned at a rear side; and wherein the light unit is configured to illuminate at least the front side of the end-tool holding part.

17. A power tool comprising:

a main housing that extends in a first direction;

a motor accommodated in the main housing and configured to generate a driving force;

a hammer case provided adjacent to the main housing and having an outer peripheral surface;

an end-tool holding part that is configured to hold an end tool;

a driving-force transmitting mechanism accommodated in the hammer case, the driving-force transmitting mechanism being configured to transmit the driving force to the end-tool holding part;

a handle housing connected to the main housing, the handle housing extending in a second direction that intersects the first direction;

a trigger switch provided at the handle housing and adjacent to the hammer case, the trigger switch being configured to control power supply to the motor;

a light-unit mounting part that is provided at the outer peripheral surface of the hammer case and that is formed integrally with the hammer case, the light-unit mounting part being formed with an insertion hole and with a slit;

a light unit positioned below the hammer case and including a lighting element and a light cover having an outer peripheral surface and an engaging part, the light unit being accommodated in the insertion hole, the engaging part of the light unit engaging the slit; and a protector cover that covers the outer peripheral surface of the hammer case and the light unit with a covering range ranging from a position above the hammer case to a position below the light unit.

18. The power tool as claimed in claim 17, further comprising a cover that covers the outer peripheral surface of the hammer case and that accommodates the light-unit mounting part and the light unit.

19. A power tool comprising:

a main housing that extends in a first direction;

a motor accommodated in the main housing and configured to generate a driving force;

a hammer case provided adjacent to the main housing and having an outer peripheral surface;

an end-tool holding part that is configured to hold an end tool, wherein the main housing, the hammer case, and the end-tool holding part are arranged in the first direction, such that the end-tool holding part is positioned at a front side and that the main housing is positioned at a rear side;

a driving-force transmitting mechanism accommodated in the hammer case, the driving-force transmitting mechanism being configured to transmit the driving force to the end-tool holding part;

a handle housing connected to the main housing, the handle housing extending in a second direction that intersects the first direction;

a trigger switch provided at the handle housing and adjacent to the hammer case, the trigger switch being configured to control power supply to the motor;

a guide sleeve that is provided at a front end of the hammer case;

a rib that protrudes from the outer peripheral surface of the hammer case and that is provided between the trigger switch and the guide sleeve with respect to the first direction, the rib being integral with the hammer case;

a light unit including a lighting element that irradiates light, and a holder member that holds the lighting element and that is mounted to the rib; and a cover that covers the outer peripheral surface of the hammer case and that accommodates the light-unit mounting part and the light unit.

20. A power tool comprising:

a motor;

a housing accommodating the motor and having a front side;

a case provided at the front side of the housing and having a lower portion and an outer peripheral surface;

an end tool mounting portion connected to the motor and protruding from the case;

a light element positioned at the lower portion of the case; and a cover that covers the outer peripheral surface of the case and the light element.

21. The power tool as claimed in claim 20, wherein the cover includes a light-unit accommodating part for covering the light element; and the power tool further comprising a transparent resin provided frontward of the light element, the light-unit accommodating part having a protruding length greater than that of the transparent resin.

22. An impact tool comprising:

a motor;

a housing accommodating the motor and made from a resin;

a hammer connected to the motor;

an anvil impactingly driven by the hammer in a rotational direction a hammer case accommodating the hammer and the anvil and connected to the housing, the hammer case being made from a metal;

an end tool mounting portion protruding from the hammer case;

a light element illuminating an area adjacent to the end tool mounting portion; and a cover covering at least a part of an outer peripheral surface of the hammer case and at least a part of the light element, the light element being positioned frontward of a rear end of the anvil.

23. The impact tool as claimed in claim 22, further comprising a lead wire connected to the light element, and a circuit board disposed in the housing, the lead wire being connected to the circuit board and disposed below the hammer case.

* * * * *